United States Patent [19]

Pincherri

[11] Patent Number: 4,676,570

[45] Date of Patent: Jun. 30, 1987

[54] FUNCTIONAL PLUG PLATE COVERS FOR ELECTRICAL OUTLETS

[76] Inventor: Anthony J. Pincherri, Salem Harbor, 107 Bayswater, Andalusia, Pa. 19020

[21] Appl. No.: 778,678

[22] Filed: Sep. 23, 1985

[51] Int. Cl.[4] ..... H01R 13/44

[52] U.S. Cl. ..... 439/148; 439/892

[58] Field of Search ..... 339/36, 38, 75

[56] References Cited

U.S. PATENT DOCUMENTS 1,588,183 6/1926 Goddard ..... 339/38

*Primary Examiner*—Gil Weidenfeld
*Assistant Examiner*—Paula A. Austin
*Attorney, Agent, or Firm*—Florence U. Reynolds

[57] ABSTRACT

A cordless plug-plate cover has prongs capable of being inserted into a socket of an electrical outlet. The plate is detachably and adjustably attached to the outer surface of the head of the plug by means of, e.g. hook and loop fabric, non-permanent adhesive or magnet/metal combination, so as to at least partially cover the outlet and to permit changing of plates for different visual effects and use with various sizes and shapes of outlets.

4 Claims, 8 Drawing Figures

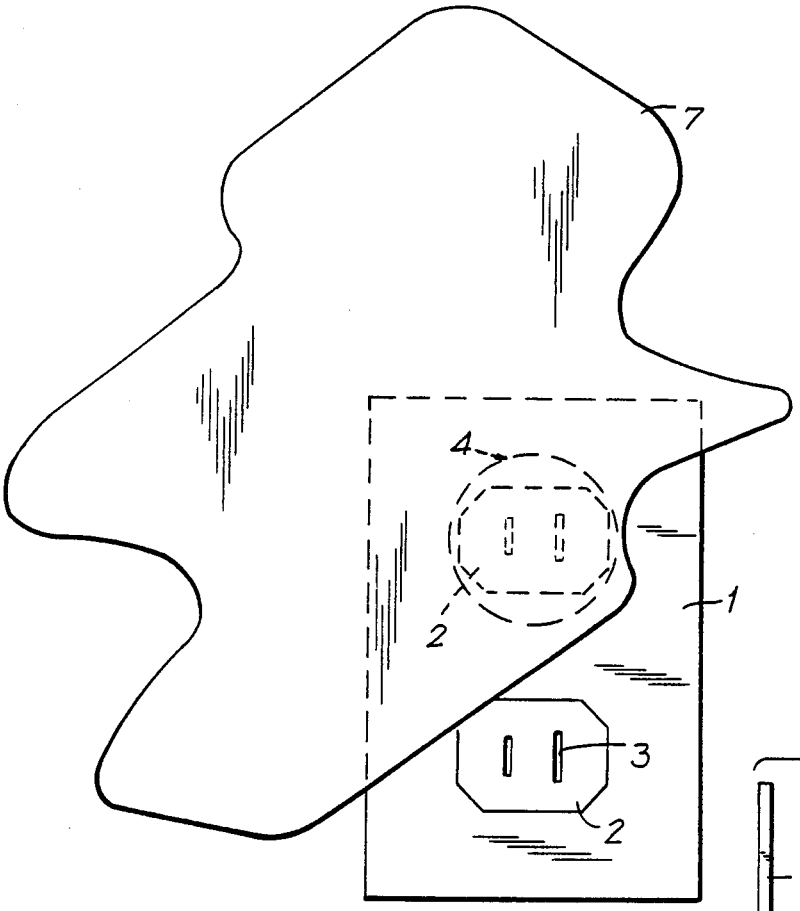
FIG. 5
FIG. 6
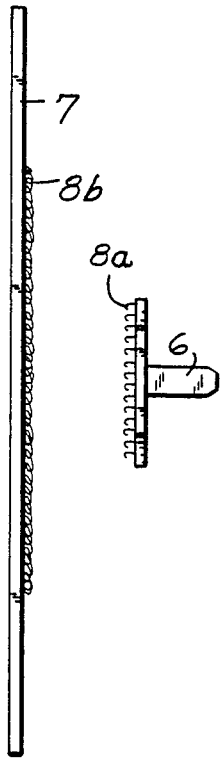
FIG. 7
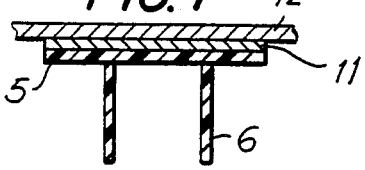

FUNCTIONAL PLUG PLATE COVERS FOR ELECTRICAL OUTLETS

BACKGROUND OF THE INVENTION

The present invention relates generally to cordless plugs, and specifically to plugs with attached platelets, which are inserted into electrical outlets and function as displays of are, information, or advertising.

More specifically, the device of the invention is constructed in such a way as to cover electrical outlets entirely or partially in an adjustable fashion and in so doing attach other shapes of art, art deco and/or non-art forms into common electrical outlets.

Most often, plain electrical outlets are unattractive, distractive, and antagonistic to the decor of a room. Uncovered, open outlets are also a source of danger from electrical shock, if prodded with elecrically conducting elements. Also, dust and small loose objects, such as Christmas tree needles, may enter or clog unused outlets.

Many various items for protection and beautification of wall sockets and switch plates, are already available in the marketplace. One such product is the "GE-Safety Cap". Other products include safety night lights, in the shape of seashells or cartoon characters.

One object of the invention is to provide an electrical outlet cover characterized by having an adjustable means of attachment of a cover plate to a plug.

Another object of the invention is to provide an electrical outlet cover for design displays and general displays of other works.

Still another object is to provide an electrical outlet cover for advertisement.

SUMMARY OF THE INVENTION

In accordance with the invention, there is provided a cordless plug-plate combination capable of being inserted in an electrical outlet. The plug has an outer surface and prongs on the opposite side of the outer surface, the prongs being capable of being inserted into the socket part of the outlet. The plate is adjustably and non-permanently attached to the surface of the plug so as to cover any desired portion of the outlet and to be repeatedly removed. The surface area of one side of the plate is sufficient to cover at least part of the electrical outlet. The outer surface of the plate may contain a decorative design, company logo, advertising copy or the like. In this way, unused electrical outlets serve a useful purpose without consuming electrical energy.

BRIEF DESCRIPTION OF THE DRAWINGS

Many of the features and advantages of the present invention will be apparent from the following description of embodiments thereof, illustrated in the accompanying drawings in which:

FIG. 5 is a top plan view of an electrical outlet cover of non-particular shape, in state of function, i.e., partially covering the outlet shown in FIG. 1;

FIG. 6 illustrates a break-a-way function of an electrical cover plate with VELCRO backing detached from the plug with VELCRO facing;

FIG. 7 is a cross-section view of a fourth embodiment of an electric outlet cover according to the invention wherein the attachment means is a magnet/metal combination.

DETAILED DESCRIPTION

The plate and plug components of the electrical outlet cover may be made of various materials, such as plastics, cardboard, paper, wood, cork, ceramics, rubber, glass, metal and combinations thereof. However, for safety reasons, the plug preferably has non-conducting prongs. If metal prongs are used, the head of the plug should be of a non-conducting material. The preferred material for the plate is a thin plastic, e.g. polystyrene. Such plastics are readily available, inexpensive and easy to work with.

The plate may be of various shapes and thicknesses, e.g., boxed or having curvature to create either a flat, topographic or textured effect. The design on the plate may consist of pictures or forms, such as famous characters, reprinted art work, a company logo, a brand name, familiar product design or any other graphic or non-graphic representation.

The attachment means between the plug and the plate components should be of a non-permanent nature so that the plug and plate may be separated repeatedly to permit changing the plate as desired for different visual effects or exposure of part or all of the sockets of the electrical outlet for functional electrical use.

The preferred attachment means comprises a hook and loop fabric, such as sold under the trademark VELCRO. The hook-containing strip of fabric is attached to either the plug or the plate component and the loop-containing fabric is attached to the other component. On pressure contact the two pieces of fabric intermesh and form a secure but separable attachment means.

Another attachment means comprises a non-permanent adhesive applied to one or both components on their mating surfaces. Such adhesives are manufactured by the 3M Company for use in non-permanent adhesive tape and Post-it ® notes.

A third attachment means comprises a magnet/metal combination, e.g., a plug with a magnetic outer surface and a plate having a metallic mating surface.

The attachment means (if applied to the plate) is applied to a large enough area of the plate so that the plug may be attached to the plate at various locations. In this way, the plate may cover an electrical outlet completely or partially if one desires to plug an appliance or lamp into one or more sockets of the outlet. The adjustable attachment also makes the outlet cover adaptable to various sizes and shapes of outlets.

Figure 1A:
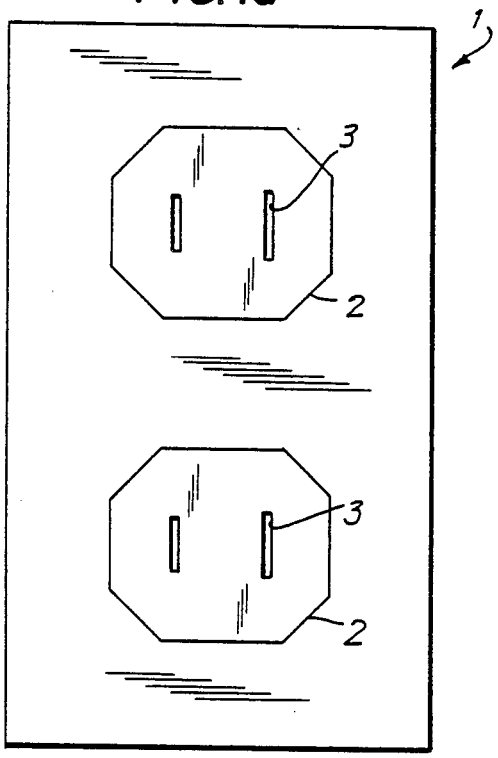
FIG. 1*a* is a frontal view of a conventional electrical outlet.

The invention will be more clearly understood from the drawings. FIG. 1*a* shows a typical electrical outlet 1 having two sockets 2 with slots 3.

Figure 1B:
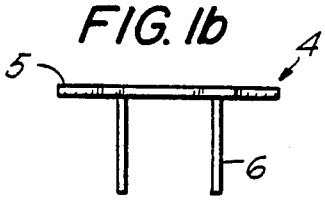
FIG. 1*b* is a side-elevation view of a cordless plug.

FIG. 1*b* shows a cordless plug 4 having an outer surface 5 and prongs 6.

Figure 2:
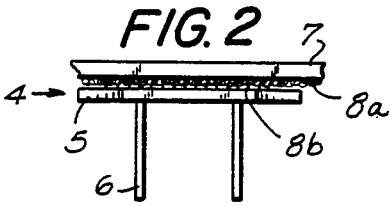
FIG. 2 is a side elevation view of one embodiment of an electrical outlet cover according to the invention showing the plate attached to the plug by means of a hook and loop fabric.

FIG. 2 shows an outlet cover according to the invention comprising a plug having a head 5 and prongs 6 and attached to a plate 7 by means of VELCRO TM strips 8*a* and 8*b*.

Figure 3:
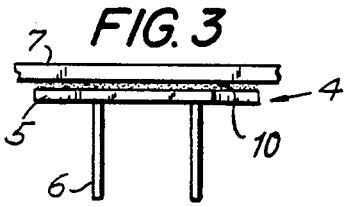
FIG. 3 is a side elevation view of a second embodiment of an electrical outlet cover according to the invention showing the plate attached to the plug by means of an adhesive applied to the plug.
Figure 4:
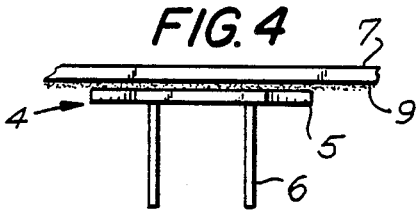
FIG. 4 is a side elevation view of a third embodiment of the electric outlet cover according to the invention showing the plate attached to the plug by means of an adhesive applied to the plate.

FIGS. 3 and 4 show other embodiments of the outlet cover according to the invention wherein the attachment means comprises a coating 9 and 10 of non-permanent adhesive applied to the plug head 5 or to the plate 7, respectively.

FIG. 5 shows a plate 7 partially covering an electrical outlet 1 so that one socket 2 may be exposed for electrical use.

FIG. 6 shows a plug having VELCRO TM fabric attachment means 8*a* and 8*b* on the outer surface of its head 5 and on a larger area of the plate 7, respectively. From this it can be seen how the position of the plate 7 may be varied with respect to the head 5 of the plug because of the larger surface area of the VELCRO TM fabric on the plate.

FIG. 7 shows a plug with head 5 and prongs 6 of synthetic plastic material. The outer surface of the head 5 is covered with a magnetic coating 11. The plate 12 is of a metal which will be attracted to the magnetic coating.

It is clear that many variations in the shape of the plug-plate cover and the type of attachment means may be made without departing from the scope of the invention as defined in the attached claims.

I claim:

1. A cover for an electrical outlet, said cover comprising a cordless plug having an outer surface and having prongs on the opposite side of said surface, said prongs capable of being inserted into a socket of said outlet; a plate of a size capable of at least partially covering said outlet; and non-permanent attachment means between a larger surface of said plate and the outer surface of said plug, wherein said attachment means provides adjustable attachment of said larger surface of said plate in infinitely variable planar positions on the outer surface of said plug.

2. The cover as in claim 1, wherein said attachment means comprises intelocking hook and loop fabric.

3. The cover as in claim 1, wherein said attachment means comprises a non-permanent adhesive.

4. The cover as in claim 1, wherein said attachment means comprises a magnet/metal combination.

* * * * *